United States Patent [19]

Meister

[11] Patent Number: 4,992,915

[45] Date of Patent: Feb. 12, 1991

[54] LIGHTING FIXTURE HAVING UNITARY FOLD-OUT LAMP SOCKETS

[75] Inventor: Barry J. Meister, North Caldwell, N.J.

[73] Assignee: Steelcraft Fluorescent Company, Newark, N.J.

[21] Appl. No.: 416,873

[22] Filed: Oct. 4, 1989

[51] Int. Cl.[5] ..... F21S 3/00

[52] U.S. Cl. ..... 362/217; 362/287; 362/427; 439/226; 439/232

[58] Field of Search ..... 362/217, 260, 220, 225, 362/285, 287, 288, 427, 429, 430; 439/226, 234, 232–235, 237, 238, 528, 552, 553

[56] References Cited

U.S. PATENT DOCUMENTS

| | | | |
|---|---|---|---|
| 3,176,260 | 3/1965 | Pasucci | 362/217 |
| 4,422,132 | 12/1983 | Towbridge | 362/147 |
| 4,772,216 | 9/1988 | Szymanek | 362/217 |
| 4,881,156 | 11/1989 | Schemitz et al. | 362/287 |

OTHER PUBLICATIONS

Crownlite, Lighting, Feb. 1955, p. 39 (10 pages).

*Primary Examiner*—Stephen F. Husar
*Assistant Examiner*—D. M. Cox
*Attorney, Agent, or Firm*—Lerner, David, Littenberg, Krumholz & Mentlik

[57] ABSTRACT

A lighting fixture is disclosed with a U-shaped channel member having a first end and a second end including a web and first and second upstanding side walls with a first end joined to said web and a second end, and preferably including a pair of spaced-apart unitary socket members mounted at the first and second ends of the channel member for removably mounting a lamp therebetween, each of the unitary socket members including a base member between the first and second upstanding side walls of the channel member and normally located at a position spanning the second ends of the first and second upstanding side walls of the channel member, the base members including mounting means for mounting a lamp receptacle above the upstanding side walls, a pair of downturned side walls extending from the base member along the upstanding side walls of the channel member within the channel member, an end wall extending from the base member and located between the upstanding side walls at the first and second ends of the channel member, and pivoting means providing a pivot connection between the unitary socket members and the channel member, the pivoting means pivotally interconnecting the first and second upstanding side walls of the channel member with the pair of downturned side walls of the unitary socket members, whereby upon pivoting the unitary socket members about the pivoting means the socket assemblies can be disposed in a compact shipping position entirely within the channel member.

25 Claims, 4 Drawing Sheets

LIGHTING FIXTURE HAVING UNITARY FOLD-OUT LAMP SOCKETS

BACKGROUND OF THE INVENTION

The present invention relates to fluorescent lighting fixtures and, in particular, to fluorescent lighting fixtures having lamp sockets that are foldable for compact shipping and storage, and for protection from breakage during same.

A typical fluorescent lighting fixture has a U-shaped channel with lamp sockets at each end that accept straight elongated fluorescent bulbs. The lamp sockets extend outwardly at right angles from the ends of the lamp fixture and are constructed of a brittle insulation material. The sockets break easily if handled roughly, such as during shipment to industrial, commercial and residential locations for installation by electricians.

In addition to being subject to breakage, the size of the package required for shipping fluorescent light fixtures is increased simply to accommodate the outwardly extending lamp sockets at each end. The size of the package is further increased when padding materials are also included to protect the sockets from breakage. This increases the cost of packaging, storing and shipping the fixtures.

The prior art has addressed this problem with fluorescent light fixtures having lamp sockets capable of being stored within the fixture channel, where they are less prone to breakage and can be stored in a smaller carton. However, the prior art has addressed this problem in a manner that makes the fabrication and manufacture of the fixture more complicated for factory workers, and the assembly of the fixture more complicated for electricians.

U.S. Pat. No. 3,555,268 discloses a fluorescent lighting fixture constructed from a U-shaped channel having a bracket on each end with which a plurality of lamp sockets are detachably engageable. The brackets and sockets are stored in the channel for shipping and storage. A series of time-consuming steps are required to be performed by an electrician assembling this fixture, which includes an end wall 15 which is integral with the channel 10. The bracket 11 is positioned within the channel for sliding engagement with the sockets after they are mounted thereon.

U.S. Pat. No. 3,770,952 discloses a fluorescent lighting fixture constructed from a U-shaped channel having a pivotable bracket on each end on which one or more lamp sockets are located. The brackets are pivotable into the channel to protect the sockets and reduce the size of the fixture during shipping and storage, and then pivotable into an upright position for installation of the lighting fixture. The pivot connection is between the channel and at least one side of the bracket and includes a pair of curved outstruck leaves protruding from either the channel or the bracket into an aperture provided in the other part. The aperture must be sized to permit passage of the leaves when the brackets are pivoted in the channel and to lock the bracket into place when pivoted upright.

Unnecessary costs are incurred in the manufacture of this fixture to provide curved outstruck protruding leaves properly aligned with apertures that permit the leaves to pass in one position and lock the leaves into place in another. Thus, instead of a single pivot point, this device includes two such points in this rather elaborate and complicated structure, which requires a rather expensive die in order to fabricate same. The mating of the parts is also labor-intensive. Indeed, U.S. Pat. No. 4,422,132 discloses at column 1, lines 30–38 and at column 3, lines 10–14, that difficulties have been encountered in rapidly aligning the pivot connections on a mass production basis for the fixture of U.S. Pat. No. 3,770,952. In addition, an electrician is required to perform the additional step of attaching end plates to each end when assembling this fixture.

U.S. Pat. No. 4,422,132 discloses a fluorescent lighting fixture similar to the one of U.S. Pat. No. 3,555,268 except that the pivot connections have been modified and relocated to simplify manufacture. Extra costs would still be required to provide specially shaped ears and apertures that form a pivoting means that allow the end bracket to be inserted in one position and latched into place in another position. Furthermore, the attachment of end plates by electricians is still required.

An easily fabricated, manufactured and assembled fluorescent lighting fixture capable of storing the lamp sockets entirely within the fixture channel for efficient storage and shipping without breakage would be highly desirable.

SUMMARY OF THE INVENTION

The above requirements are addressed by the present invention.

One aspect of the present invention provides a lighting fixture having a U-shaped channel member with a first end and a second end. The channel member includes a web and first and second upstanding side walls having a first end joined to the web and a second end, and at least one, but preferably a pair of spaced-apart unitary socket members mounted at the first and second ends of the channel member, between which a lamp can be removably mounted. Each unitary socket member includes a base member between the first and second upstanding side walls of the channel member, normally located at a position spanning the second ends of the first and second upstanding side walls of the channel member. The base member includes mounting means for mounting a lamp receptacle above the upstanding side walls, a pair of downturned side walls extending from the base member along the upstanding side walls of the channel member within the channel member, and an end wall extending from the base member and located between the upstanding side walls at the first and second ends of the channel member. Pivot means provide a pivot connection between the unitary socket member and the channel member. The pivot means pivotably interconnects the first and second upstanding side walls of the channel member with the pair of downturned side walls of the unitary socket member. Upon pivoting the unitary socket member about the pivot means, the socket member can be disposed in a compact shipping position entirely within the channel member.

By providing an end wall on each unitary socket member, the task of assembling the lighting fixture is simplified.

In a preferred embodiment of the lighting fixture of the present invention, the pivot means is an axial pivot means permanently affixed between each of the pair of downturned side walls and the first and second upstanding side walls.

According to a further embodiment of the lighting fixture of the present invention, locking means are provided on each of the unitary socket members and the first and second ends of the channel member that cooperate to lock the unitary socket members in their normal location so that the base members span the second ends of the first and second side walls of the channel member when the socket members are extended outwardly in an upright position.

According to another embodiment of the lighting fixture of the present invention, the end walls of the unitary socket members include a pair of projecting tab members, each of which extends from opposite sides of the end walls in a direction substantially parallel to the pair of downturned side walls, and affixing means are provided for affixing a pair of projecting tab members to the pair of downturned side walls. In a preferred embodiment the affixing means comprise finger means extending from the pair of projecting tab members and corresponding openings in the pair of downturned side walls, preferably in which the pair of downturned side walls include depression means surrounding the openings whereby the finger means extending from the pair of projecting tab members may be inserted through the openings and bent into the depression means so that the finger means is substantially flush with the downturned side walls and the downturned side walls are positively secured to the end walls.

In accordance with another embodiment of the lighting fixture of the present invention, the end wall of the unitary socket member includes at least one mounting element extending inwardly from the end wall at a predetermined location whereby the lamp receptacle may be mounted directly on the mounting element to thereby maintain the lamp receptacle in position. In a preferred embodiment the at least one mounting element comprises a punched-out portion of the end wall, and preferably has a substantially pyramidal configuration.

In accordance with another embodiment of the lighting fixture of the present invention, the base member of the unitary socket member comprises biasing means projecting downwardly from the base member for biasing the lamp receptacle downwardly when the lamp receptacle is mounted with respect to the base member. In a preferred embodiment the bias means comprises a surface projection formed in the base member.

Other objects, features and advantages of the present invention will be more readily apparent from the detailed description of the preferred embodiment set forth below, taken in conjunction with the accompanying drawings.

DETAILED DESCRIPTION OF THE PREFERRED EMBODIMENT

Figure 1:
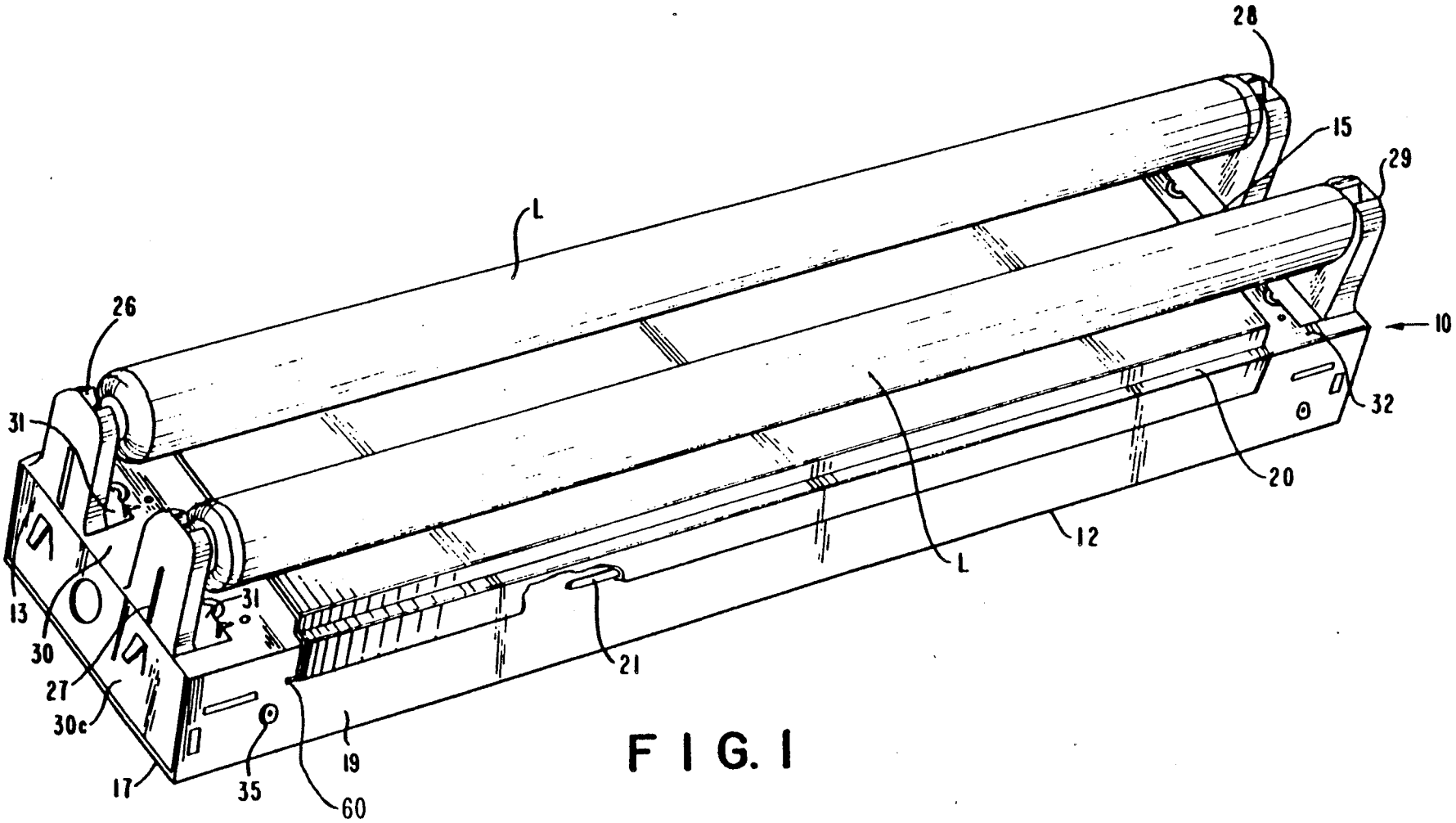
FIG. 1 is an elevational, perspective view of a fluorescent lamp fixture of the present invention.

Referring now to the drawings, in which like reference numerals refer to like portions thereof, FIG. 1 illustrates a lighting fixture 10 having an elongated channel member 12 with, at opposite ends, a pair of socket assemblies 13 and 15, each of which comprises a unitary socket member. Two elongated cylinder lamps L are shown mounted between the unitary socket members 13 and 15. It will be understood, however, that the present invention is not limited to this embodiment, which is thus only presented as being representative of a conventional lighting fixture element into which this invention may be incorporated. This fixture could thus include a single lamp or any further number of lamps, etc.

Figure 2:
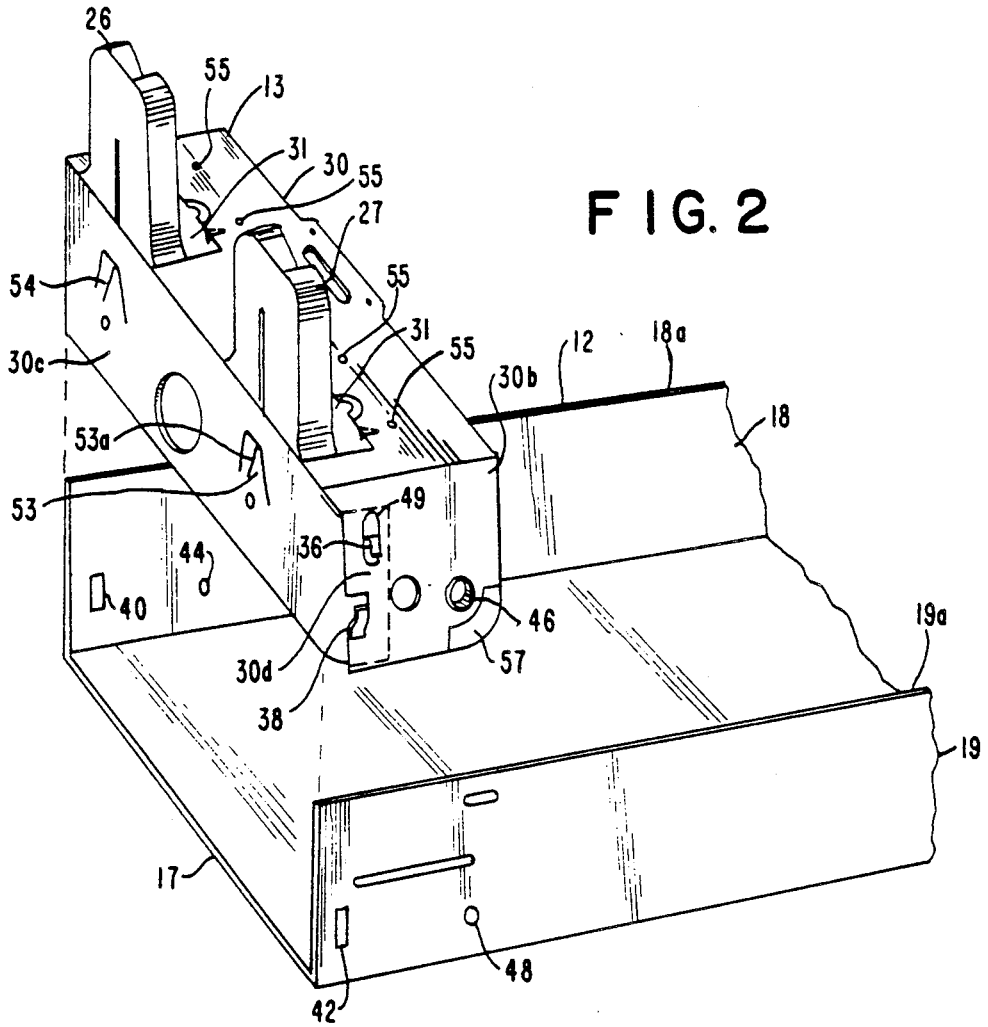
FIG. 2 is an exploded, partial, perspective view of an end portion of the fixture of the present invention, the view illustrating a channel member and a socket member.

As shown in the exploded end view of FIG. 2, the channel member 12 is a one piece metal construction having a web 17 and a pair of side walls 18 and 19 projecting upwardly from the web 17 to form a generally U-shaped open channel. The depth of this channel can take a number of forms, and this invention is in no way restricted thereby. A channel closure plate 20 (FIG. 1) attaches to and spans the upper edges 18*a* and 19*a* of the side walls 18 and 19, respectively, to close the top of the channel member 12. The closure plate 20 may be releasably fastened to the socket members 13 and 15 and/or to the channel member 12 by conventional means, such as by means of a pressure-fit, utilizing interconnecting tabs, or by means of screws or the like. In the preferred embodiment shown in FIG. 1, the closure plate 20 is pressure-fit onto the channel member 12 by application to a number of outwardly extending tabs 21, one of which is shown in the cutaway view in FIG. 1. Thus, the depending wall of closure plate 20 includes an inwardly extending lip #60 which can be snap- or pressure-fit onto these outwardly extending tabs 21.

Figure 3:
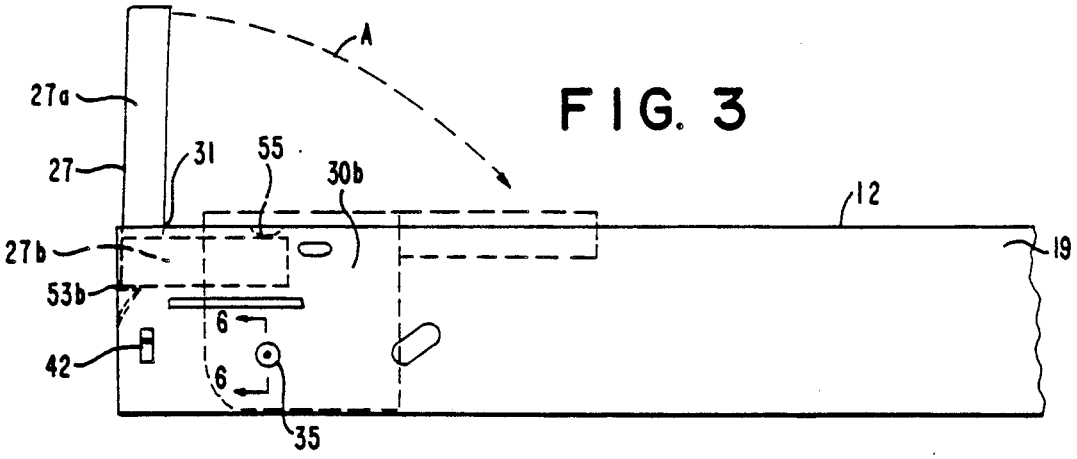
FIG. 3 is a partial, side, elevational view of the left-hand portion of the fixture of FIG. 1 illustrating in full lines a lamp socket member in its extended position and illustrating in broken lines the lamp socket member in its shipping position.

The lighting fixture 10 is illustrated in FIG. 1 in its assembled configuration. In this configuration, lamp sockets 26–29 extend outwardly from the channel member 12. Because lamp sockets 26–29 are constructed of a brittle plastic insulating material that is prone to breakage, the fixture 10 is designed so that the socket members 13 and 15 are capable of being stored and shipped with the lamp sockets 26–29 substantially completely received within the channel member 12, as illustrated with dot-dash lines in FIG. 3. This protects the lamp sockets 26–29 during shipment so that breakage is kept to a minimum. The lamp sockets 26–29 themselves have an L-shaped configuration as can be seen in FIG. 3 hereof. This includes an upstanding lamp engaging portion 27*a* and a base portion 27*b* projecting therefrom. The upstanding lamp engaging portion 27*a*, whose front face can be seen in FIG. 4, includes conventional means for the insertion and interconnection of fluorescent lamp assemblies, and can be a one-pin, two-pin, or other conventional such socket mechanism. Thus, while a conventional two-pin connector is shown in these Figures, the present invention applies equally to other connectors, such as one-pin connectors, which will generally be dimensioned differently than the the two-pin connectors shown herein. The base portion 27*b* is also conventional, and includes conductor openings by which appropriate conductors can be threaded into the interior of the lamp sockets 26–29 for energization of the lamps themselves.

As illustrated in FIGS. 1 and 2, unitary socket members 13 and 15 include respective base members 30 and 32, upon which the lamp sockets 26–29 can be mounted. Typically, this includes openings 31 into which these lamp sockets 26–29 can be inserted in the manner shown in FIG. 3, with the base portion 27*b* thereof parallel to and below the base members 30 and 32. The specific method for mounting these lamp sockets is discussed below. One of the unitary socket members, namely socket member 13, is shown from the front in FIG. 4, and from the rear in FIG. 5. The base member 30 thereof has downturned sides, 30*a* and 30*b*, and a downturned end wall 30*c*, which extends between the downturned sides 30*a* and 30*b*. The relationship between the end wall 30*c* and downturned sides 30*a* and 30*b* is also shown in FIG. 2. The opposite ends of the end wall 30*c* include projecting tab members 30*d* which can again best be seen in FIG. 2 as outlined in phantom by the dotted lines thereon. This is because these wraparound projecting tab members 30*d* extend behind the faces of the downturned sides 30*a* and 30*b* and parallel thereto. Means are then provided for affixing the projecting tab members 30*d* to the respective downturned sides 30*a* and 30*b* so as to stabilize the overall unitary construction of the unitary socket members 13 and 15.

Figure 8:
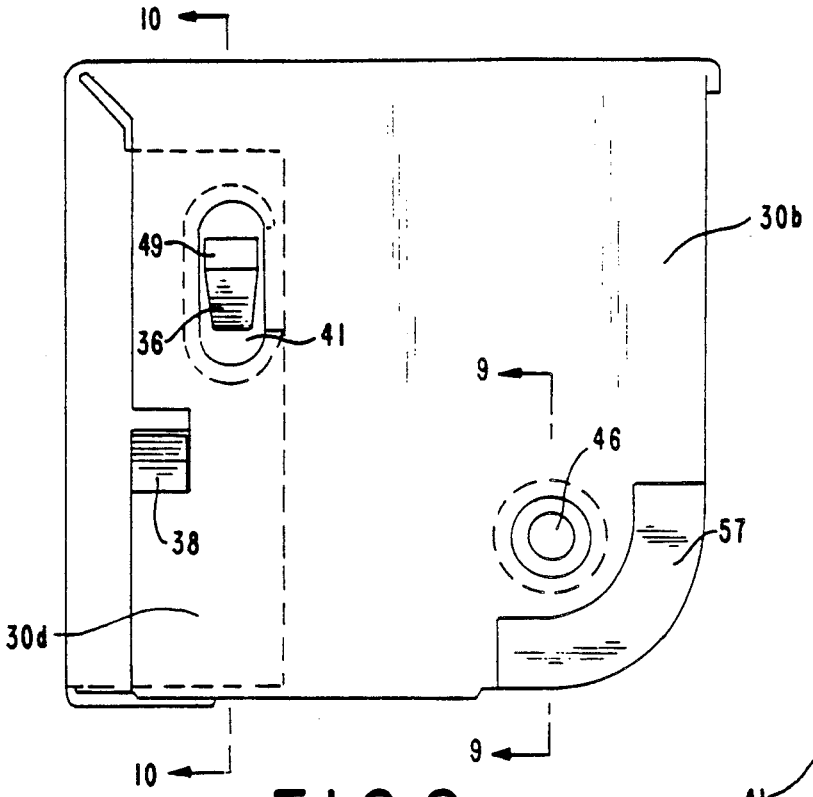
FIG. 8 is an enlarged, side, elevational view of a socket member of the present invention.
Figure 10:
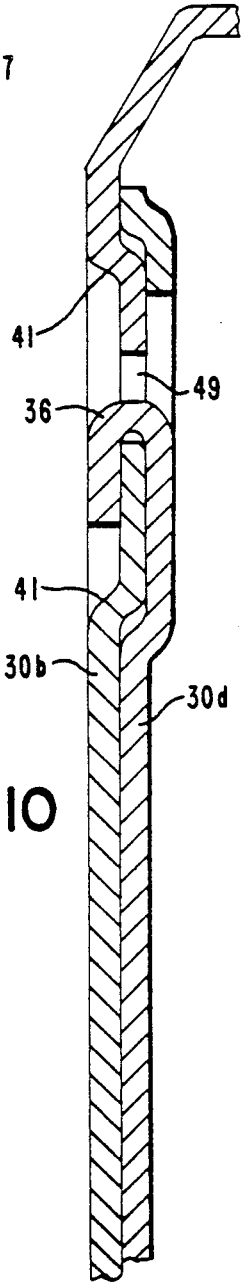
FIG. 10 is an enlarged, fragmentary, sectional view of the affixing mechanism of the socket member taken along lines 10—10 of FIG. 8.

The particular means used in the embodiment shown in FIG. 2 for affixing the projecting tab members 30*d* to the downturned side 30*b* of the unitary socket member 13 can best be seen in FIGS. 8 and 10. This includes a finger 36 which is punched out from the material forming projecting tab 30*d*. In addition, the wall of downturned side 30*b* includes an aperture 49 so that finger 36 can be bent to project through aperture 49 and then be pressed downwardly against the surface of downturned side 30*b*, as can best be seen in FIG. 10. Furthermore, the portion of downturned side 30*b* in which aperture 49 is formed is contained within a depressed region 41 so that upon affixing projecting tab 30*d* to the downturned side 30*b* in the manner discussed above, the bent-over finger 36 can lie within the plane of the outer surface of the downturned side 30*b*, again as can best be seen in FIG. 10, and will, therefore, not interfere with the subsequent pivotable movement of the unitary socket member 13. As is also discussed above, this configuration stabilizes the entire unitary socket member 13 into a rigid, solid, unitary configuration for meeting the requirements of the invention discussed herein.

Figure 4:
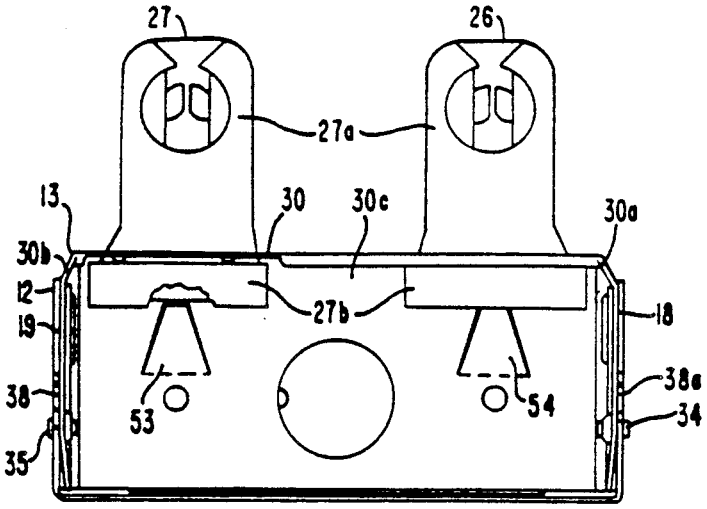
FIG. 4 is a front elevational view of the socket member illustrated in FIG. 2.
Figure 5:
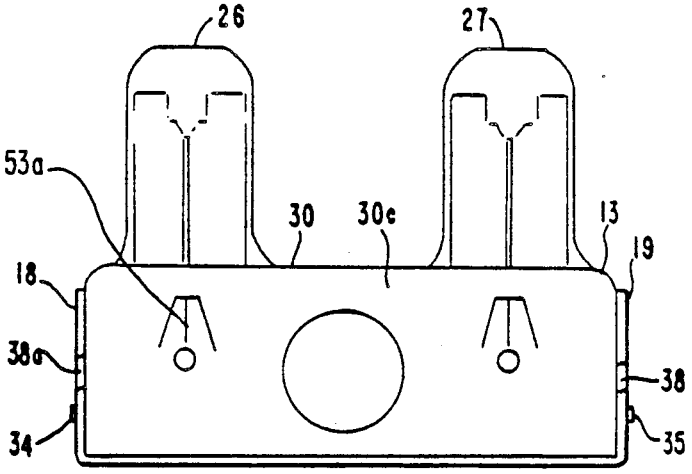
FIG. 5 is a rear elevational view of the socket member illustrated in FIG. 2.

In order that socket members 13 and 15 may fold lamp sockets 26–29 into and out of the channel member 12, there is provided means to pivotally connect the unitary socket members 13 and 15 to channel member 12. Preferably, the pivotal connection functions by way of an axial means permanently affixed between the unitary socket members 13 and 15 and the channel member 12. As shown in FIGS. 3–5 for socket member 13, the pivoting connection is provided by rivets 34 and 35, which respectively affix the side walls 18 and 19 of the channel member 12 to the downturned sides 30*a* and 30*b* of socket member 13. The pivotable connection of side wall 19 of channel member 12 to the downturned side 30*b* of socket member 13 by rivet 35 is also represented by FIG. 6.

Figure 6:
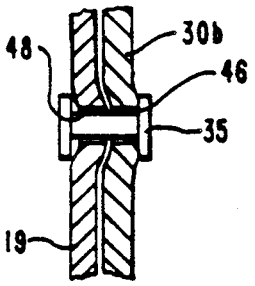
FIG. 6 is an enlarged, fragmentary, sectional view taken along lines 6—6 of FIG. 3.
Figure 9:
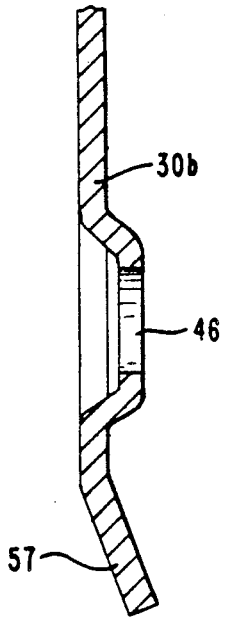
FIG. 9 is an enlarged, fragmentary, sectional view of the pivot member taken along lines 9—9 of FIG. 8.

The particular preferred configuration for this pivotable connection is best seen in FIGS. 6 and 9 hereof. Thus, in order to affix rivet 35 between the corresponding portions of downturned side 30*b* and side wall 19 of the channel member 12, each requires a corresponding aperture designated by reference numerals 46 and 48, respectively. These apertures, in turn, are produced by an extrusion technique so that when formed in the respective wall members they create a depressed area as can be seen in FIG. 9. Since similar depressed areas are associated with each of apertures 46 and 48, as can best be seen in FIG. 6, by the mere juxtaposition of the socket member 13 with the appropriate portion of the side walls 18 and 19, the depressed portion associated with aperture 48 acts as a male member in association with the corresponding depressed portion of aperture 46, now acting as a female member, to provide interconnection and pivotable movement between the socket member 13 and the channel member 12. That is, this occurs on an interim basis, even without the insertion of rivet 35 therethrough. The subsequent insertion of rivet 35 then renders the pivotable connection therebetween permanent, again as already facilitated by the above corresponding relationship between apertures 46 and 48. This is yet another element of the present invention which facilitates its manufacture and construction.

Figure 7:
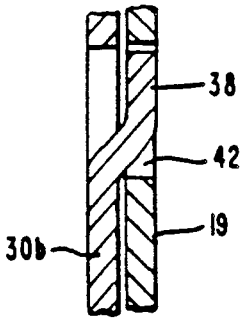
FIG. 7 is an enlarged, fragmentary, sectional view of the latching mechanism of the present invention.

To secure the socket members 13 and 15 in the outwardly extended or normal operating configuration, an optional means is provided to lock each of the socket members 13 and 15 to the respective ends of channel member 12. This locking means prevents the socket members 13 and 15 from inadvertently rotating into their storage position within channel member 12. (See FIG. 7) As shown in FIGS. 2–5, the locking function for unitary socket member 13 with channel member 12 is provided by protrusions 38*a* and 38, which are, respectively, struck outwardly from downturned sides 30*a* and 30*b*, which cooperate with rectangular apertures 40 and 42 provided in side walls 18 and 19 of channel member 12, respectively. The engagement of protrusion 38 of downturned side 30*b* and aperture 42 of side wall 19 is shown in FIG. 7. Equivalent locking means are provided on the opposite side wall of the depicted socket member.

As best seen in FIG. 2, for one side of unitary socket member 13, the protrusion 38 engages the aperture 42 at a location displaced from the pivot point 46 in a direction towards the end wall 30*c*. This, therefore, prevents pivoting about pivot point 46 when the device is installed. Once the protrusion 38 and the aperture 42 are engaged, together with the protrusion and aperture on the opposite side of unitary socket member 13, it is impossible for the socket member to be pivoted into the shipping or storage position unless sides 18 and 19 of channel member 12 are spread apart to disengage both protrusion 38 from aperture 42 and the protrusion and aperture on the opposite side of unitary socket member 13. Inadvertent rotation of the unitary socket member 13 is thereby prevented.

Channel member 12 is enclosed along its length by closure plate 20 in the manner discussed above, where means are provided to releasably fasten the sides of the closure plate 20 in position spanning the side walls of channel member 12. The ends of the closure plate 20 can also, if desired, be releasably fastened to unitary socket members 13 and 15 by means of snap fasteners or the like.

The simple and efficient method for mounting lamp sockets 26–29 on the base members 30 and 32 will now be described, with particular reference to lamp socket 27 and base member 30 shown in FIGS. 3 and 4 hereof. As stated previously, the lamp socket 27 is basically inserted into aperture 31 in base member 30 by initially inserting lamp engaging portion 27*a* into aperture 31 and then moving base motion 27*b* parallel to the bottom surface of base member 30 into the configuration shown in FIG. 3. In conjunction therewith, end wall 30*c* includes mounting elements 53 and 54. These are preferably punched out from the surface of end wall 30*c* in the manner shown in FIGS. 2 through 5. In particular, they are punched from the partially trapezoidal configuration shown in these Figures inwardly along a center line 53*a* so that the upper portion thereof extends inwardly forming surface 53*b* of the pyramidal configuration thereof in the manner shown in FIG. 3 thereof. This portion 53*b*, in turn, acts as a base into which the corner of base member 27*b* can snap-fit when lamp engaging portion 27*a* is inserted into aperture 31. Thus, without adding any additional elements, the lamp socket 27 is snapped into place in the position shown in FIG. 3. Additional means, however, can be provided to more firmly mount the lamp socket 27, and more particularly to insure that it firmly holds the lamps themselves when they are inserted into the configuration shown in FIG. 1. More particularly, biasing members 55 are located on the bottom surface of the base member 30, preferably comprising surface projections or tabs formed in the base member itself and extending therebelow. A pair of these biasing members 55 is shown in the embodiment of FIGS. 2 and 4 for each of the lamp sockets. The presence of these biasing members 55 thus urges the right-hand side of the base member 27*b* of the lamp socket 27 downwardly, which, in turn, urges the upstanding lamp-engaging portion 27*a* of the lamp socket 27 downwardly in the direction of arrow A as shown in FIG. 3, that is, towards the corresponding lamp socket 29 at the other end of the fixture of the present invention. This, in turn, helps grasp the lamp L firmly therebetween, and improves the strength and operation of the lamp fixtures of the present invention. As is mentioned above, however, this can also be applied to other types of lamp sockets, such as conventional one-pin lamp sockets. Where the sockets are somewhat large, it may be more important that one employ the pair of spaced-apart biasing members 55 for each such socket, as shown in FIGS. 2 and 4, or it may also be necessary to include wings extending laterally from the socket members to help stabilize them and prevent the lamp-engaging portion 27*a* from passing downwardly into the space between the side walls of the channel member 12. Of course, the size of aperture 31 will also need to be specifically designed to accommodate each such type of lamp socket utilized herein. In addition, screws can also be used in order to more firmly fasten the lamp sockets in place. For example, in FIG. 2 one-half of a screw thread aperture is illustrated at each of apertures 31, for use in conjunction with a corresponding threaded aperture in the lamp socket.

Another method of facilitating the construction of the present invention, and particularly insertion of the socket members 13 and 15 into position between the side walls 18 and 19 of the channel member 12, is the presence of a ramp member 57 on the lower surface of the downturned side 30*b*, as can best be seen in FIGS. 8 and 9. Thus, ramp member 57 is formed by bending an arcuate portion of the downturned side 30*b*, in the manner shown in FIG. 9, away from the location of the side wall 19 of the channel member 12. This ramp member 57 is arcuate, and is juxtaposed adjacent to the aperture 46 in the downturned side 30*b*. In this manner, when placing the unitary socket member 13 into position within the channel member 12 from the position shown in FIG. 2 between the side walls 18 and 19 thereof, the protruding male portion of side wall 19 forming aperture 48, as shown in FIG. 6, can be guided up onto ramp 57 into the female portion of aperture 46 formed in downturned side 30*b*. The male and female members can then snap into position to facilitate further construction of the lighting fixture hereof, placement of the rivet 35, etc.

In manufacturing the fixture 10, the socket members 13 and 15 are inserted into the channel member 12 in the manner described above, and then rotated into the folded-down position of FIG. 3 by the temporary pivotable connection created by the male-female connection between the holes for insertion of the rivets. The permanent pivoting means are then provided, in the case of socket member 13, by connecting side walls 18 and 19 of channel member 12 with downturned sides 30*a* and 30*b* of socket member 13 by fastening rivet 34 through hole 44 and the non-depicted hole of downturned side 30*a* and rivet 35 through holes 46 and 48, respectively. The same procedures apply to the installation of socket member 15 in the opposite end of channel member 12. The fixture 10 is then packed in a carton that is sized to receive the fixture 10 and its closure plate 20.

The fixture 10 can then be installed subsequent to such shipment by removing it from its shipping carton and pivoting the socket member 13 and 15 outwardly about the pivotal axes formed by the rivets affixing each to the channel member, into the lamp-mounting position illustrated in FIG. 1. In the case of socket member 13, protrusions 38*a* and 38 of downturned sides 30*a* and 30*b* engage the apertures 40 and 42 of side walls 18 and 19 of channel member 12 to latch unitary socket member 13 in an outwardly extended position. Socket member 15 is locked into an outwardly extended position in the same manner. The closure plate 20 is installed as described above after the fixture 10 is installed.

The above described invention provides an improved lighting fixture that has fold-out lamp sockets capable of folding within the fixture to protect the lamp sockets and conserve package space during shipping and storage. The fixture is both simple and less costly to fabricate, manufacture and assemble.

The invention being thus described, it will be obvious that the same can be varied in many ways. Such variations are not to be regarded as a departure from the spirit and scope of the invention, and all such modifications are intended to be included within the scope of the following claims.

We claim:

1. A lighting fixture comprising a U-shaped channel member having a first end and a second end comprising a web and first and second upstanding side walls including a first end joined to said web and a second end, and at least one unitary socket member mounted at at least one of said first and second ends of said channel member for removably mounting a lamp thereon, said socket member comprising a base member between said first and second upstanding side walls of said channel member and normally located at a position spanning said second ends of said first and second upstanding side walls of said channel member, said base member including mounting means for mounting a lamp receptacle above said upstanding side walls, a pair of downturned side walls extending from said base member along said upstanding side walls of said channel member within said channel member, an end wall extending from said base member between said upstanding side walls at said first and second ends of said channel member, pivoting means providing a pivot connection between said unitary socket member and said channel member, said pivoting means pivotally interconnecting said first and second upstanding side walls of said channel member with said pair of downturned side walls of said unitary socket member, and locking means on said unitary socket member and at said at least one of said first and second ends of said channel member cooperating to lock said unitary socket member in said normal position so that said base member spans said second end of said first and second upstanding side walls of said channel member, said locking means comprising protrusions struck from said downturned side walls of said socket member and corresponding apertures in said first and second upstanding side walls of said channel member which engage to lock said socket member in said normal location, whereby upon pivoting said unitary socket member about said pivoting means, said socket member can be disposed in a compact shipping position entirely within said channel member, and said socket member can be locked in said normal location.

2. The lighting fixture of claim 1, including a pair of said unitary socket members at both said first and second ends of said channel member.

3. The lighting fixture of claim 1, wherein said pivoting means comprises axial pivoting means permanently affixing said pair of downturned side walls of said unitary socket member to said upstanding side walls of said channel member.

4. The lighting fixture of claim 3, wherein said axial pivoting means comprises a rivet.

5. The lighting fixture of claim 1, wherein said pivoting means includes a male connector portion projecting from said first and second upstanding side walls and formed by an extruded aperture therein and a female connector portion in said corresponding pair of downturned side walls.

6. The lighting fixture of claim 1, wherein said end wall of said unitary socket member includes a pair of projecting tab members, each of said projecting tab members extending from opposite sides of said end wall in a direction substantially parallel to said pair of downturned side walls, and affixing means for affixing said pair of projecting tab members to said pair of downturned side walls.

7. The lighting fixture of claim 6, wherein said affixing means comprises finger means extending from said pair of projecting tab members and corresponding openings in said pair of downturned side walls.

8. The lighting fixture of claim 7, wherein said pair of downturned side walls includes depression means surrounding said openings whereby said finger means extending from said pair of projecting tab members may be inserted through said openings and bent into said depression means so that said finger means is substantially flush with said downturned side walls.

9. The lighting fixture of claim 1, wherein said end wall of said unitary socket member includes at least one mounting element extending inwardly from said end wall at a predetermined location whereby said lamp receptacle may be mounted directly on said mounting element to thereby maintain said lamp receptacle in position.

10. The lighting fixture of claim 9, wherein said at least one mounting element comprises a punched-out portion of said end wall.

11. The lighting fixture of claim 10, wherein said punched-out portion of said end wall has a substantially pyramidal configuration.

12. The lighting fixture of claim 1, wherein said base member of said unitary socket member comprises biasing means projecting downwardly for said base member for biasing said lamp receptacle downwardly when said lamp receptacle in mounted with respect to said base member.

13. The lighting fixture of claim 12, wherein said biasing means comprises a surface projection formed in said base member.

14. The lighting fixture of claim 5, wherein said pair of downturned side walls includes ramp means proximate to said female connector portion, whereby insertion of said male connector portion into said female connector portion is facilitated.

15. The lighting fixture of claim 14, wherein said ramp means comprises an arcuate portion of said downturned side walls surrounding a portion of said female connector portion.

16. A lighting fixture comprising a U-shaped channel member having a first end and a second end comprising a web and first and second upstanding side walls including a first end joined to said web and a second end, and at least one unitary socket member mounted at at least one of said first and second ends of said channel member for removably mounting a lamp thereon, said socket member comprising a base member between said first and second upstanding side walls of said channel member and normally located at a position spanning said second ends of said first and second upstanding side walls of said channel member, said base member including mounting means for mounting a lamp receptacle above said upstanding side walls, a pair of downturned side walls extending from said base member along said upstanding side walls of said channel member within said channel member, an end wall extending from said base member between said upstanding side walls at said first and second ends of said channel member, said end wall including a pair of projecting tab members, each of said projecting tab members extending from opposite sides of said end wall in a direction substantially parallel to said pair of downturned side walls, affixing means for affixing said pair of projecting tab members to said pair of downturned side walls, and pivoting means providing a pivot connection between said unitary socket member and said channel member, said pivoting means pivotally interconnecting said first and second upstanding side walls of said channel member with said pair of downturned side walls of said unitary socket member, whereby upon pivoting said unitary socket member about said pivoting means, said socket member can be disposed in a compact shipping position entirely within said channel member.

17. The light fixture of claim 16, wherein said affixing means comprises finger means extending from said pair of projecting tab members and corresponding openings in said pair of downturned side walls.

18. The lighting fixture of claim 17, wherein said pair of downturned side walls includes depression means surrounding said openings whereby said finger means extending from said pair of projecting tab members may be inserted through said openings and bent into said depression means so that finger means is substantially flush with said downturned side walls.

19. A lighting fixture comprising a U-shaped channel member having a first end and a second end comprising a web and first and second upstanding side walls including a first end joined to said web and a second end, and at least one unitary socket member mounted at at least one of said first and second ends of said channel member for removably mounting a lamp thereon, said socket member comprising a base member between said first and second upstanding side walls of said channel member and normally located at a position spanning said second ends of said first and second upstanding side walls of said channel member, said base member including mounting means for mounting a lamp receptacle above said upstanding side walls, a pair of downturned side walls extending from said base member along said upstanding side walls of said channel member within said channel member, an end wall extending from said base member between said upstanding side walls at said first and second ends of said channel member, said end wall including at least one mounting element extending inwardly from said end wall at a predetermined location whereby said lamp receptacle may be mounted directly on said mounting element to thereby maintain said lamp receptacle in position, and pivoting means providing a pivot connection between said unitary socket member and said channel member, said pivoting means pivotally interconnecting said first and second upstanding side walls of said channel member with said pair of downturned side walls of said unitary socket member, whereby upon pivoting said unitary socket member about said pivoting means, said socket member can be disposed in a compact shipping position entirely within said channel member.

20. The lighting fixture of claim 19, wherein said at least one mounting element comprises a punched-out portion of said end wall.

21. The lighting fixture of claim 20, wherein said punched-out portion of said end wall has a substantially pyramidal configuration.

22. A lighting fixture comprising a U-shaped channel member having a first and a second end comprising a web and first and second upstanding side walls including a first end joined to said web and a second end, and at least one unitary socket member mounted at at least one of said first and second ends of said channel member for removably mounting a lamp thereon, said socket member comprising a base member between said first and second upstanding side walls of said channel member and normally located at a position spanning said second ends of said fist and second upstanding side walls of said channel member, said base member including mounting means for mounting a lamp receptacle above said upstanding side walls, said mounting means including biasing means projecting downwardly from said base member for biasing said receptacle downwardly when said lamp receptacle is mounted with respect to said base member, a pair of downturned side walls extending from said base member along said upstanding side walls of said channel member within said channel member, an end wall extending from said base member between said upstanding side walls at said first and second ends of said channel member, and pivoting means providing a pivot connection between said unitary socket member and said channel member, said pivoting means pivotally interconnecting said first and second upstanding side walls of said channel member with said pair of downturned side walls of said unitary socket member, whereby upon pivoting said unitary socket member about said pivoting means, said socket member can be disposed in a compact shipping position entirely within said channel member.

23. The lighting fixture of claim 22 wherein said biasing means comprises a surface projection formed in said base member.

24. A lighting fixture comprising a U-shaped channel member having a first end and a second end comprising a web and first and second upstanding side walls including a first end joined to said web and a second end, and at least one unitary socket member mounted and at least one of said first and second ends of said channel member for removably mounting a lamp thereon, said socket member comprising a base member between said first and second upstanding side walls of said channel member and normally located at a position spanning said second ends of said first and second upstanding side walls of said channel member, said base member including mounting means for mounting a lamp receptacle above said upstanding side walls, a pair of downturned side walls extending from said base member along said upstanding side walls of said channel member within said channel member, an end wall extending from said base member between said upstanding side walls at said first and second ends of said channel member, and pivoting means providing a pivot connection between said unitary socket member and said channel member, said pivoting means pivotally interconnecting said first and second upstanding side walls of said channel member with said pair of downturned side walls of said unitary socket member and including a male connector portion projecting form said first and second upstanding side walls and formed by an extruded aperture therein and a female connector portion in said corresponding pair of downturned side walls, said pair of downturned side walls further including ramp means proximate to said female connector portion, whereby upon pivoting said unitary socket member about said pivoting means, said socket member can be disposed in a compact shipping position entirely within said channel member.

25. The lighting fixture of claim 24, wherein said ramp means comprises an arcuate portion of said downturned side wall surrounding a portion of said female connector portion.

* * * * *

UNITED STATES PATENT AND TRADEMARK OFFICE

CERTIFICATE OF CORRECTION

PATENT NO. : 4,992,915

DATED : February 12, 1991

INVENTOR(S) : Barry J. Meister

It is certified that error appears in the above-identified patent and that said Letters Patent is hereby corrected as shown below:

Column 10, line 17, "in" should read --is--.
Column 12, line 47, "form" should read --from--

Signed and Sealed this

Eighteenth Day of August, 1992

*Attest:*

DOUGLAS B. COMER

*Attesting Officer*

*Acting Commissioner of Patents and Trademarks*